US009845217B2

(12) United States Patent
Shin

(10) Patent No.: US 9,845,217 B2
(45) Date of Patent: Dec. 19, 2017

(54) FINANCIAL DEVICE AND MEDIUM STACKING APPARATUS

(71) Applicant: LG CNS CO., LTD., Seoul (KR)

(72) Inventor: Sang Hoon Shin, Seoul (KR)

(73) Assignee: LG CNS CO., LTD., Seoul (KR)

( * ) Notice: Subject to any disclaimer, the term of this patent is extended or adjusted under 35 U.S.C. 154(b) by 0 days.

(21) Appl. No.: 15/174,118

(22) Filed: Jun. 6, 2016

(65) Prior Publication Data

US 2016/0355360 A1 Dec. 8, 2016

(30) Foreign Application Priority Data

Jun. 5, 2015 (KR) ..... 10-2015-0080153

(51) Int. Cl.
*B65H 43/04* (2006.01)
*B65H 31/06* (2006.01)
(Continued)

(52) U.S. Cl.
CPC ..... *B65H 31/06* (2013.01); *B65H 1/025* (2013.01); *B65H 5/06* (2013.01); *B65H 7/20* (2013.01); *B65H 31/04* (2013.01); *B65H 31/24* (2013.01); *G07D 11/0021* (2013.01); *G07F 19/20* (2013.01); *G07F 19/202* (2013.01); *G07F 19/203* (2013.01); *B65H 2701/1912* (2013.01)

(58) Field of Classification Search
CPC . B65H 1/02; B65H 1/025; B65H 3/54; B65H 31/06; B65H 2405/20; B65H 2405/21; B65H 2405/212; G07D 11/0021
See application file for complete search history.

(56) References Cited

U.S. PATENT DOCUMENTS

2002/0060405 A1* 5/2002 Iwai ..... B65H 29/46 271/177
2003/0047601 A1* 3/2003 Nomiyama ..... G07D 11/0027 235/381
(Continued)

FOREIGN PATENT DOCUMENTS

EP 1603085 A1 12/2005
EP 2600322 A1 6/2013
(Continued)

OTHER PUBLICATIONS

Office Action dated Oct. 31, 2016 in Korean Application No. 10-2015-0080153.
(Continued)

*Primary Examiner* — Prasad V Gokhale
(74) *Attorney, Agent, or Firm* — Saliwanchik, Lloyd & Eisenschenk

(57) ABSTRACT

A medium stacking apparatus comprises a stacking surface for stacking a medium; a first guide to guide the stacking of the medium in the case of stacking of the medium and to press the medium in the case of separating of the medium stacked on the stacking surface; and a second guide that is capable of supporting the medium stacked on the stacking surface, the first guide including a first plate, and a second plate that is rotatably connected to the first plate, the second plate being rotated about the first plate in the case of stacking of the medium, and a portion or all of the second plate being overlapped with the first plate in the case of separating of the medium.

20 Claims, 10 Drawing Sheets

(51) Int. Cl.

| | |
|---|---|
| ***B65H 1/02*** | (2006.01) |
| ***B65H 31/04*** | (2006.01) |
| ***G07F 19/00*** | (2006.01) |
| ***G07D 11/00*** | (2006.01) |
| ***B65H 5/06*** | (2006.01) |
| ***B65H 7/20*** | (2006.01) |
| ***B65H 31/24*** | (2006.01) |

(56) References Cited

U.S. PATENT DOCUMENTS

2004/0212143 A1* 10/2004 Yoshioka ..... B65H 29/38 271/176
2005/0263582 A1* 12/2005 Yokoi ..... G07D 11/0012 235/379
2006/0087068 A1* 4/2006 Bittenbender ..... B65H 1/025 271/2
2009/0028678 A1* 1/2009 Kutzer ..... B07C 1/025 414/351
2009/0152805 A1* 6/2009 Nomiyama ..... B65H 1/025 271/227
2012/0031728 A1* 2/2012 Lee ..... G07F 19/20 194/342
2013/0140756 A1 6/2013 Kim
2013/0334763 A1* 12/2013 Haydt, III ..... B65H 5/00 271/11
2014/0318925 A1 10/2014 Lee et al.
2015/0298920 A1* 10/2015 Yamashita ..... G07D 11/0018 271/147

FOREIGN PATENT DOCUMENTS

| | | | |
|---|---|---|---|
| JP | 2015014969 | A | 1/2015 |
| KR | 100227403 | B1 | 8/1999 |
| KR | 102010012619 | A | 12/2010 |
| KR | 101094499 | B1 | 12/2011 |
| KR | 20130116640 | A | 10/2013 |

OTHER PUBLICATIONS

European Search Report dated Nov. 2, 2016 in European Application No. 16172893.6.

* cited by examiner

FINANCIAL DEVICE AND MEDIUM STACKING APPARATUS

CROSS-REFERENCE TO RELATED APPLICATIONS

This application claims priority under 35 U.S.C. §119 to Korean Application No. 10-2015-0080153, filed Jun. 5, 2015, which entire disclosure is hereby incorporated by reference in its entirety.

BACKGROUND

Field of the Invention

A Financial device and medium staking apparatus are disclosed herein.

Background

Generally, financial devices are devices that process a financial transaction that is desired by a customer. The financial devices may deposit/withdraw a medium or automatically transfer a medium.

Automated financial devices are disclosed in Korean Patent Publication No. 10-1094499 (Registration date Dec. 8, 2011) which is a related art of the present invention.

The automated financial devices of the related art comprises a medium depositing and withdrawing device having a plurality of guiders and a plurality of pressing portions.

The plurality of the guiders may comprise a front guider, a rear guider, and a support guider.

In case of the financial device of the related art, since a medium that is supported to the supporting surface is moved by the three guiders and the pressing portions, there is a problem that the structure of the financial device of the related art is complicated.

In addition, so that a medium that is positioned between the rear guider and the pressing portion is moved to a pick-up roller, there is a problem that a shielding structure for preventing the pressing portion from being interfered with the rear guider is to be required.

Further, the rear guider is capable of pressing a medium to the side of the pick-up roller. However, there is a problem that cannot guide the stacking of a medium in the stacking process of a medium.

BRIEF SUMMARY

Embodiments provide a medium stacking apparatus and a financial device that are capable of stacking a medium on a supporting surface by a simplified structure and pressing a medium in the case of separation of the stacked medium.

A medium stacking apparatus comprises a stacking surface for stacking a medium; a first guide to guide a stacking of the medium in the case of stacking of the medium and to press the medium in the case of separating of the medium stacked on the stacking surface; and a second guide that is capable of supporting the medium stacked on the stacking surface, wherein the first guide comprises a first plate, and a second plate that is rotatably connected to the first plate, wherein the second plate is rotated about the first plate in the case of stacking of the medium, and wherein a portion or all of the second plate is overlapped with the first plate in the case of separating of the medium.

A financial device comprises a customer information acquiring part that acquires customer's information; an user interface unit that displays menu and information for depositing or withdrawing a medium and for inputting or selecting a command or information for depositing or withdrawing a medium; and a medium stacking apparatus that is capable of stacking the medium in the processing of the medium, wherein the medium stacking apparatus comprises a plurality of guides that is capable of supporting or moving the medium, wherein one guide of the plurality of the guides comprises a first plate, and a second plate that is rotatably connected to the first plate, wherein the second plate is rotated about the first plate in the case of stacking of the medium, and wherein a portion or all of the second plate is capable of pressing the medium to the side of the other guide in a state where the portion or all of the second plate is overlapped with the first plate in the case of separating the medium.

DETAILED DESCRIPTION

Figure 1:
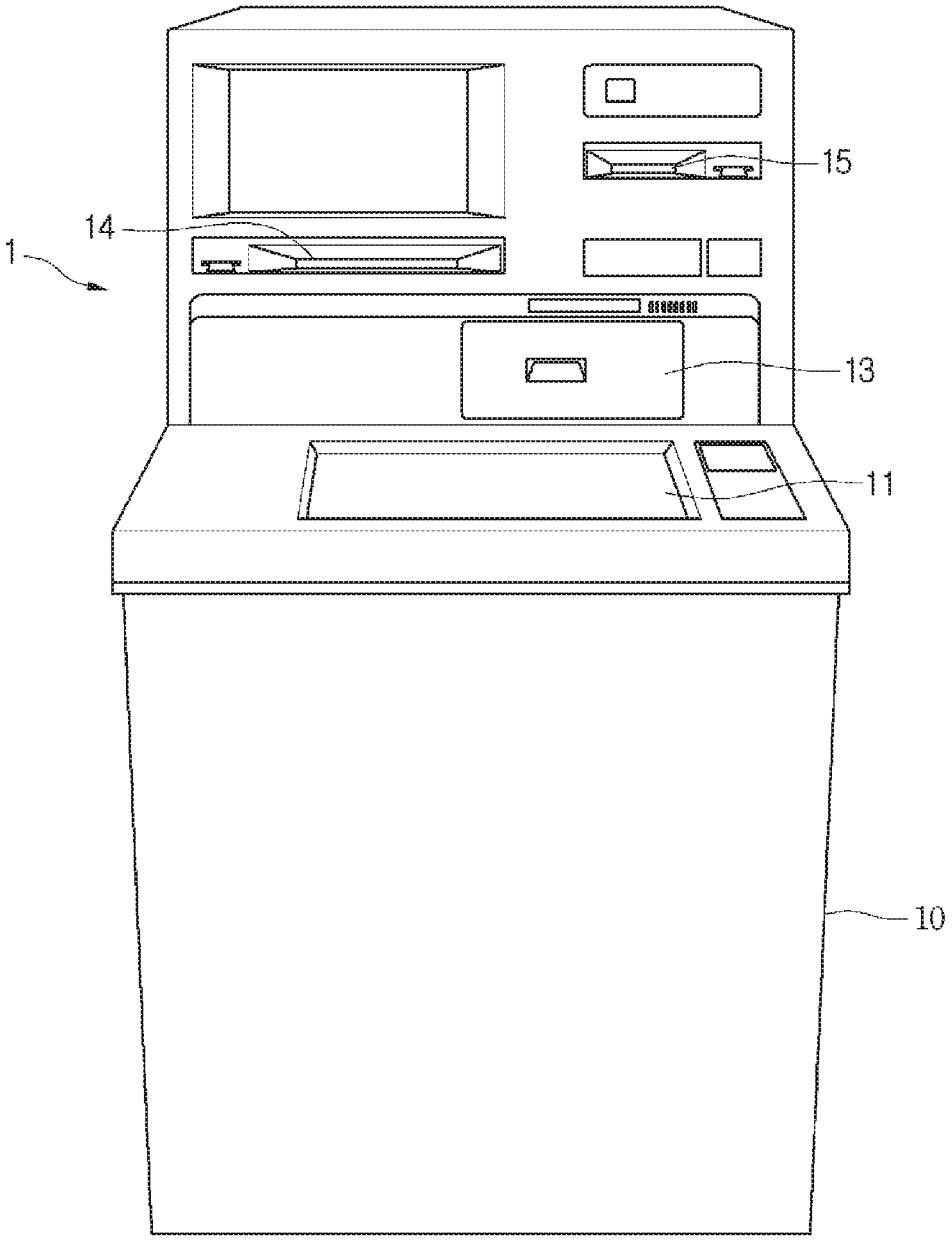
FIG. 1 is a perspective view illustrating a financial device according to an embodiment.

Hereinafter, exemplary embodiments of the present disclosure will be described with reference to the accompanying drawings. Regarding the reference numerals assigned to the elements in the drawings, it should be noted that the same elements may be designated by the same reference numerals, wherever possible, even though they are shown in different drawings. Also, in the description of embodiments, detailed description of well-known related structures or functions may be omitted when it is deemed that such description may cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial business such as medium processing including processing such as deposit processing, giro receipt, or gift certificate exchange and/or processing such as withdrawal processing, giro dispensing, or gift certificate dispensing by receiving various media such as, e.g., paper money, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial business such as a financial information system (FIS).

Hereinafter, assuming that the financial device is an ATM, an embodiment will be described. However, this assumption is merely for convenience of description, and technical idea of the present disclosure is not limited to the ATM.

Figure 2:
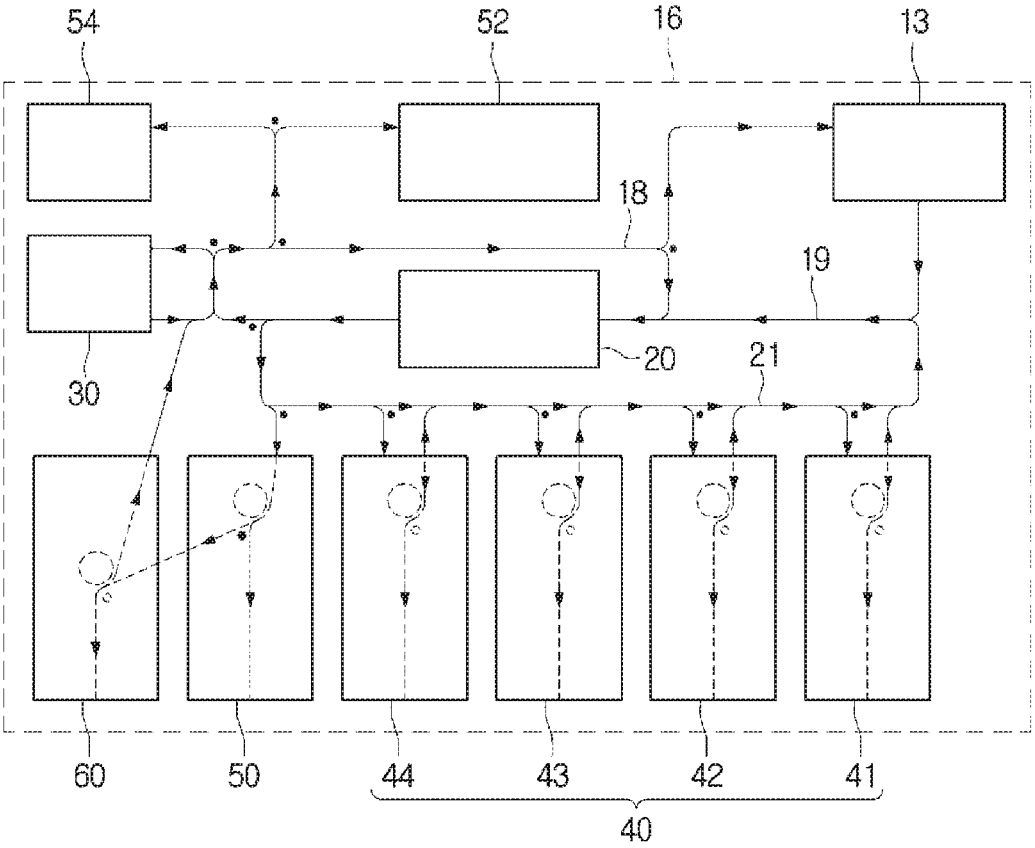
FIG. 2 is a view illustrating a configuration of a medium processing apparatus according to an embodiment.

FIG. 1 is a perspective view illustrating a financial device according to an embodiment, and FIG. 2 is a view illustrating a configuration of a medium processing apparatus according to an embodiment.

Referring to FIG. 1, a financial device 1 according to an embodiment may comprise a cabinet 10 in which a plurality of components are built.

The financial device 1 may further comprise a medium depositing and withdrawing unit 13 for depositing and withdrawing a medium.

The medium depositing and withdrawing unit 13 comprises a medium receiving space accessible by a customer. The receiving space may be opened and closed by a covering member (not shown) such as a shutter and/or a cover and may be sometimes maintained in an opened state without being closed.

The medium depositing and withdrawing unit 13 may serve as a common entrance part through which various kinds of media such as bills and checks are deposited or withdrawn. The media may be accepted into the medium depositing and withdrawing unit 13 in a bundle. Alternatively, the media may be withdrawn from the medium depositing and withdrawing module 13 in a bundle.

In addition, the financial device 1 may comprise a bankbook entrance part 14 for accepting or dispensing a bankbook and a card entrance part 15 for accepting or dispensing a card according to type of the financial device 1. The bankbook entrance part 14 or the card entrance part 15 according to the present embodiment may be called a customer information acquisition part for acquiring customer's information. The present disclosure is not limited to a kind of customer information acquisition part. For example, the customer information acquisition part may acquire information recorded in an RFID tag or USB or acquire customer's information by using biological information such as customer's fingerprint.

In addition, the financial device 1 may further comprise a user interface unit 11 that displays a menu and information for depositing or withdrawing a medium or for inputting or selecting a command or information for depositing or withdrawing a medium.

The financial device 1 may further comprise the medium processing apparatus 16. The medium processing apparatus 16 is received in the cabinet 10.

The medium processing apparatus 16 may comprise the medium depositing and withdrawing unit 13. The medium depositing and withdrawing unit 13 may perform the function of a medium stacking apparatus since the medium is stacked in the medium depositing and withdrawing unit 13 in the depositing and withdrawing process of the medium.

The medium processing apparatus 16 may further comprise a discrimination unit 20. The discrimination unit 20 may distinguish a kind of medium or determine an abnormal medium when the medium is deposited or withdrawn.

The medium processing apparatus 16 may further comprise a medium stacking apparatus for stacking and storing the medium.

The medium stacking apparatus may comprise a temporary stacking unit 30 for temporarily stacking the medium. The temporary stacking unit 30 may temporarily stack the medium that is received therein through the medium depositing and withdrawing unit 13 in a case where the customer intends to deposit the medium to the financial device 1. The medium stacked into the temporary stacking unit 30 is transferred to the medium storing box 40 to be described below when the medium depositing is finally decided by the customer. In addition, the temporary stacking unit 30 may temporarily stack the medium to be withdrawn to the medium depositing and withdrawing unit.

The medium stacking apparatus may further comprise a medium storing box 40 for storing the medium. The medium storing box 40 may comprise at least one bill storing box 41, 42, and 43 and at least one check storing box 44. In the present specification, there is no limit regarding to the number of the bill storing boxes 41, 42 and 43 and the check storing box 44. As another example, the medium storing box 40 may comprise the bill storing box or the check storing box. In addition, the medium storing box 40 may further comprise storing box that stores gift certificates, securities, tickets, or the like. In addition, the check storing box 44 may be replaced by storing box that stores gift certificates, securities, tickets, or the like.

A medium inlet for inputting the transferred medium and a medium outlet for withdrawing medium that is stacked in the medium storing box to the outside thereof is formed in the medium storing box 40. In general, the medium inlet and the medium outlet may be formed on the upper end of the box that forms the outer appearance of the medium storing box 40.

In addition, a medium separation unit in which the medium transferred from the outside of the medium storing box 40 is stacked side by side and which separates the stacked media one by one to transfer the separated medium to the outside of the medium storing box 40 is provided in the medium storing box 40. In other words, the medium stored in the medium storing box 40 may be withdrawn to the outside and the deposited medium may be stored in the medium storing box 40.

The medium stacking apparatus may comprise at least one of a first collection box 50 in which medium that is determined to be abnormal in the deposit process or a medium that is rejected in the replenishment process is stored, a second collection box 52 in which medium that is determined to be abnormal in the withdrawal process is stored, and an additional function cassette 60 for replenishing or collecting the medium. The additional function cassette 60 may store medium to be replenished in the medium storing box 40.

Further, the medium stacking apparatus may further comprise a third collection box 54 in which non-received medium is collected in a case where a customer does not receive the medium that released to the medium depositing and withdrawing unit 13.

The second collection box 52 and the third collection box 54 may be omitted in the financial device 1 of the present embodiment. In addition, the number of the second collection box 52, the third collection box 54, and the additional function cassette 60 is not limited.

Each of modules (the medium depositing and withdrawing unit, the discrimination unit, the medium storing box, temporary stacking unit, collection box, or the like) that constitutes the financial device in the present embodiment may be connected by means of a plurality of the transfer path 18, 19, and 20.

Figure 3:
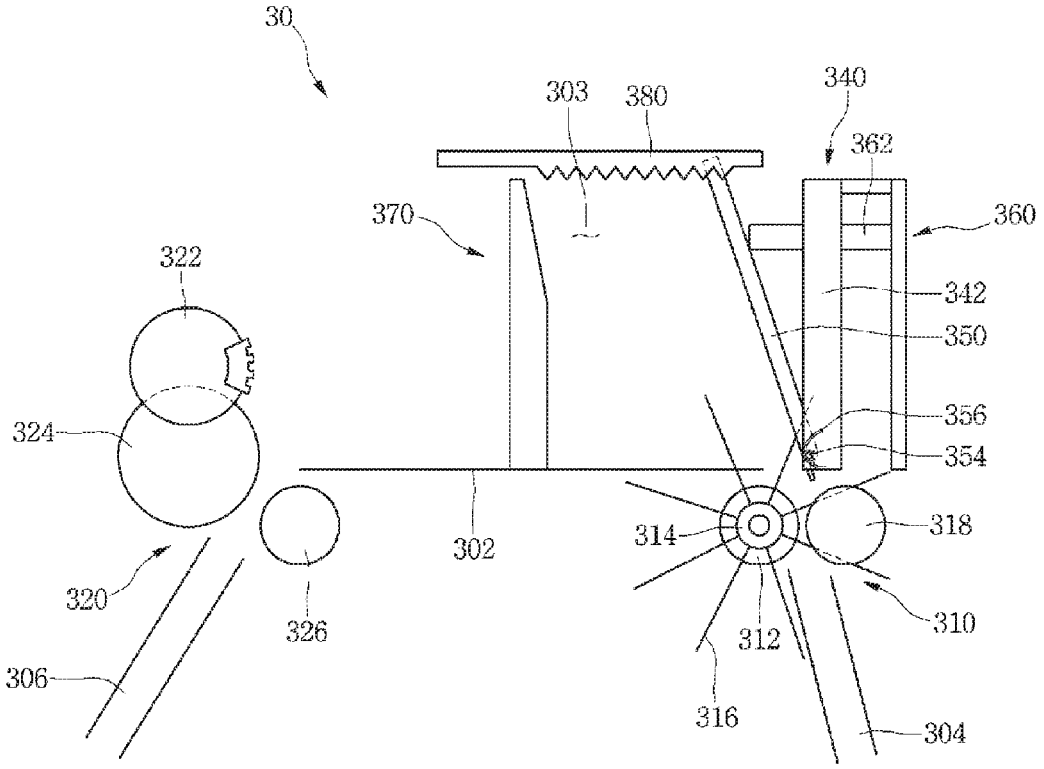
FIG. 3 is a schematic view illustrating a temporary stacking unit according to an embodiment.
Figure 4:
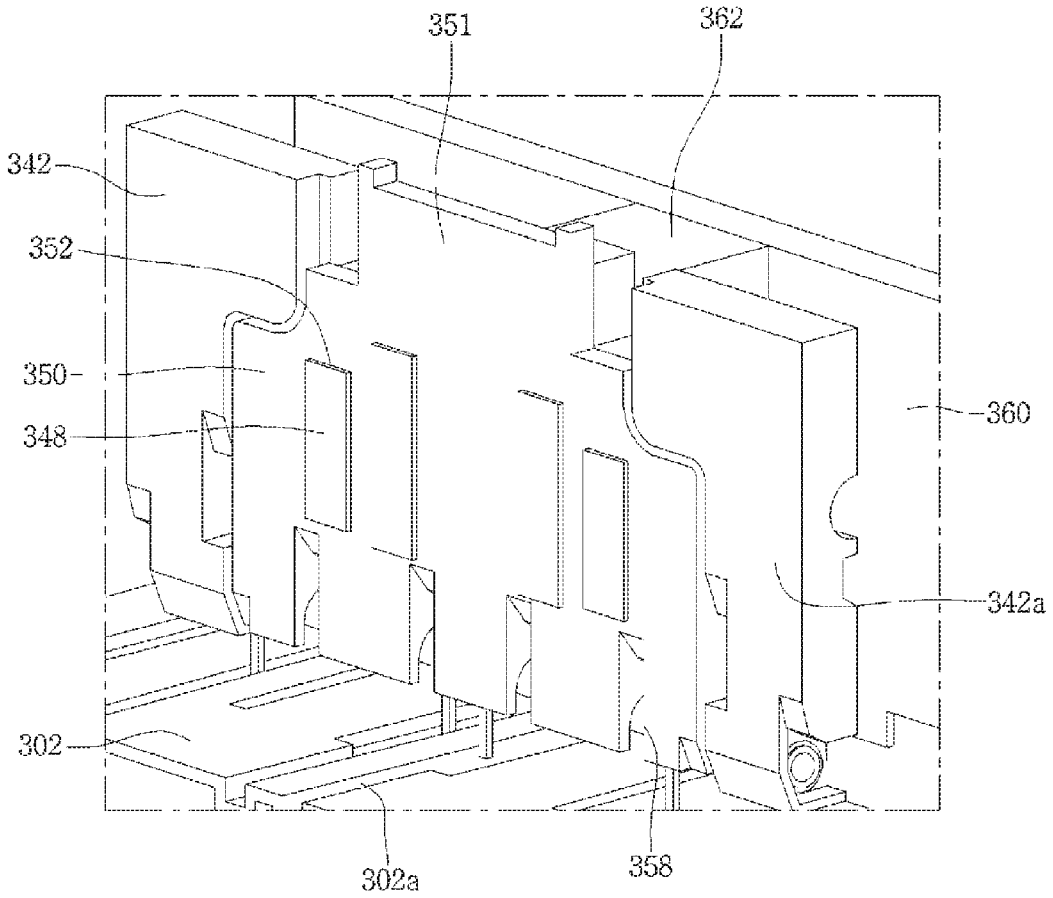
FIG. 4 is a view illustrating a state of a first guide in the case of stacking the medium according to an embodiment.
Figure 5:
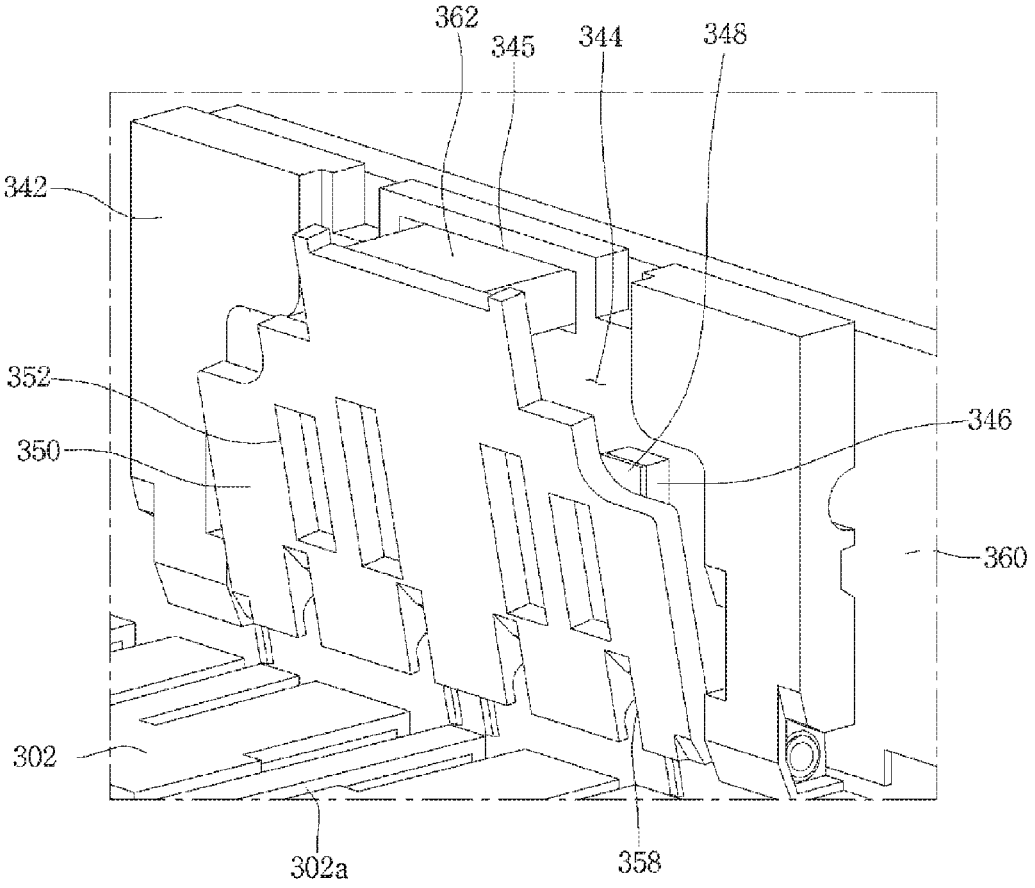
FIG. 5 is a view illustrating a changed state of the first guide for separation of the medium according to an embodiment.

FIG. 3 is a schematic view illustrating a temporary stacking unit according to an embodiment, FIG. 4 is a view illustrating a state of a first guide in the case of stacking the medium according to an embodiment, and FIG. 5 is a view illustrating a changed state of the first guide for separation of the medium according to an embodiment.

Hereinafter, a structure and operation of the guides provided in the temporary stacking unit will be described, and the structure and operation of the guides described in the temporary stacking unit is applied to the medium stacking apparatus and the medium depositing and withdrawing unit that has a medium stacking apparatus function (for example, a customer access module) in a same manner.

Referring to FIG. 3 to FIG. 5, the temporary stacking unit 30 according to an embodiment may comprise a stacking surface 302 on which the medium is stacked. The medium may be stacked to stand up so that a long side having a relatively long length of the medium is supported by the stacking surface 302.

The temporary stacking unit 30 may further comprise a stacking space 303 for temporarily stacking the medium. The stacking space 303 may be opened and closed by a shutter and/or a cover (not shown).

The temporary stacking unit 30 may further comprise a first path 304 through which the medium for temporarily stacking is transferred and a second path 306 through which the temporary stacking medium that is separated from the stacking space 303 is transferred.

The temporary stacking unit 30 may comprise a first transfer device 310 for transfer the temporary stacking medium into the stacking space 303.

The first transfer device 310 may comprise a first transfer roller 312 and a second transfer roller 318 that transfers the medium with the first transfer roller 312.

A sheet roller 314 having a wing 316 for assisting stacking of the medium is connected to a shaft of any one of the first transfer roller 312 and the second transfer roller 318. At this time, a plurality of the wings 316 is entirely disposed on the periphery of the sheet roller 314 with a predetermined distance spaced apart with each other or a plurality of the wings 316 is partially disposed on the periphery of the sheet roller 314 with a predetermined distance spaced apart with each other.

In FIG. 3, it is illustrated that the sheet roller 314 is connected to shaft of the first transfer roller 12 as an example.

The temporary stacking unit 30 may further comprise a second transfer device 320 for transfer the temporary stacking medium one by one.

The second transfer device 320 may comprise a pick-up roller 322 for picking up the temporary stacking medium, a feed roller 324 for transfer the picked up medium, and a gate roller 326 that is positioned opposite to the feed roller 324.

The gate roller 326 may maintain in a state rotating in the same direction as that of the feed roller 324 or a stationary state.

The temporary stacking unit 30 may further comprise a first guide 340 and a second guide 370 that are movable in a stacking space 303.

The first guide 340 and the second guide 370 may be moved in the stacking space 303 by means of independent movement means, respectively.

The first guide 340 may guide the stacking operation of the medium in a stacking process of the medium. Accordingly, the first guide 340 is referred to as a stacking guide.

The second guide 370 can support the medium stacked on the stacking surface 302 during the stacking process of the medium in order not to fall down the medium. Accordingly, the second guide 370 is referred to as a supporting guide.

The first guide 340 may comprise a first plate 342 and a second plate 350 that is rotatably connected to the first plate 342.

The second plate 350 may be rotatably connected to the first plate 342 by means of the hinge shaft 354, and may be folded or overlapped with the first plate 342.

The first guide 340 may further comprise an elastic member 356 that supplies a rotating force for rotating the second plate 350 in a direction overlapped with the first plate 342 to the second plate 350. A vibration by a rotation of the second plate 350 may be prevented in the case of the pick-up of medium by means of the elastic member 356.

In addition, the first guide 340 may further comprise a fixing member that fixes the second plate 350 and the first plate 342 in a state where the second plate 350 is overlapped with the first plate 342. A vibration by a rotation of the second plate 350 may be prevented in the case of the pick-up of medium by means of the fixing member.

The elastic member 356 may be a torsion spring as an example. The torsion spring is disposed around the hinge shaft 354.

In this specification, the state as in the FIG. 4 is referred to as a state where the second plate 350 is overlapped with the first plate 342. The state as in the FIG. 5 is referred to as a state where the second plate 350 is rotated about the first plate 342.

A receiving portion 344 that receives the second plate 350 is provided in the first plate 342 in order to prevent a thickness of the first guide 340 from increasing in a state where the second plate 350 is overlapped with the first plate 342. At this time, the thickness of the first guide 340 may be same as the thickness of the first plate 342 in a state where the second plate 350 is received in the receiving portion 344.

A guide surface 351 of the second plate 350 may be positioned on the same plane as the front surface 342*a* (surface facing the second guide 370) of the first plate 342 or may be positioned at the rear side of the front surface 342*a* of the first plate 342 in a state where the second plate 350 is overlapped with the first plate 342.

The first plate 342 may further comprise a projecting portion 346 for passing through the second plate 250. The friction portion 348 may be provided at least one surface of the projecting portion 346. The friction portion 348 may be formed of a rubber material as an example. As another example, it is possible for all the projecting portions 346 to be formed of a rubber material, in this case, a coupling portion is provided in the first plate 342 so that the projecting portion 346 is coupled to the first plate 342. As another example, the projecting portion 346 may be omitted and a groove (or a hole) in which a portion of the pick-up roller 322 is received may be formed in the first plate 342.

The friction plate 348 may pass through the second plate 350 and may be in contact with the medium in a separation process of the medium.

The second plate 350 may comprise a through hole 352 through which the projecting portion 346 is passed. At this time, the through hole 352 may be larger than the projecting portion 346 so that the second plate 350 and the projecting portion 346 are not interfere with each other in a rotation process of the second plate 350.

The projecting portion 346 having the friction portion 348 may be projected to the side of the second guide 370 on the guide surface 351 of the second plate 350 through the second plate 350 in a state where the second plate 350 is overlapped with the first plate 342. On the other hand, when the second plate 350 is rotated, at least a portion of the projecting portion 346 is removed from the through hole 352 and thus the projecting portion 346 is not projected from the second plate 350. In other words, when the second plate 350 is rotated, the projecting portion 346 is positioned at the rear side of the guide surface 351.

As another example, the friction portion 348 is provided on the second plate 350 and is projected form the guide surface 351 in a state where the second plate 350 is overlapped with the first plate 342. When the second plate 350 is rotated, the friction portion 348 may be configured to move so that the friction portion 348 is positioned at the rear side of the guide surface 351. As an example, it is possible to be configured that the friction portion 348 is rotatably provided to the second plate 350 and a link is connected to the friction portion 348.

The guide surface 351 for guiding the medium in the second plate 350 may be smoothly formed for stably transfer guide of the medium. As an example, the friction coefficient of the guide surface 351 is lower than the friction coefficient of the friction portion 348.

It is possible that a plurality of the ribs (not shown) is provided on the guide surface 351 in order to be in line contact with the temporary stacking medium.

A slot 358 may be provided in the lower side portion of the second plate 350 for preventing from being interfered with the wing 316 of the seat roller 314.

The temporary stacking unit 30 may further comprise a rotating guide 360 for rotating the second plate 350 about the first plate 342.

The rotating guide 360 may be disposed at the rear side of the first guide 340 and may be fixed to a frame (not shown).

The rotating guide 360 is capable of stopping the first plate 342 and rotating the second plate 350 about the first plate 342 when the first guide 340 is moved to the side of the rotating guide 360.

The rotating guide 360 may further comprise a push portion 362 that pushes the second plate 350 so that the second plate 350 is rotated about the first plate 342.

The push portion 362 may pass through the first plate 342, and a through opening 345 through which the push portion 362 is passed is provided on the first plate 342. The push portion 362 may be spaced apart from the hinge shaft 354. In addition, an operable member (not shown, roller or the like, as an example) that may be capable of relative motion with the second plate 359 without the wear of the push portion 362 is provided on the end portion of the push portion 362 when the second plate 350 is pushed and thus rotates about the first plate 342.

The push portion 362 is capable of contacting the second plate 350 through the through opening 345 of the first plate 342, during a process in which the first guide 340 moves toward the rotating guide 360 (in a right direction based on the FIG. 3).

In this state, the second plate 350 is rotated about the first plate 342 during the process in which the second plate 350 moves with the first plate 342 when the first guide 340 is further moved in a right direction. Subsequently, the first guide 340 stops when first plate 342 is in contact with the rotating guide 360.

At this time, the rotation angle of the second plate 350 may be adjusted according to a length of the push portion 362 and the position of the rotating guide 360.

As another example, it is possible that the first guide 340 does not stop as the first guide 340 is in contact with the rotating guide 360 and the first guide 340 stops by detecting the number of revolutions of the motor for moving the first guide 340.

On the other hands, the first guide 340 may move in the substantially parallel direction to the stocking surface 302 and a guide groove 302*a* may be provided in the stocking surface 302 for guiding the movement of the first guide 340.

In addition, the temporary stacking unit 30 may further comprise a damper 380 on which the medium passing through the first transfer roller 312 and the second transfer roller 318 is collided.

At this time, a portion of the second plate 350 is positioned lower than the stocking surface 302 and the remaining portion of the second plate 350 is overlapped with the damper 380 in a state where the second plate 350 is rotated so that temporary stacking medium is prevented from being caught into the second plate 350. Although it is not illustrated, a groove or slot may be formed on the damper 380 for preventing from being interfered with the second plate 350.

Figure 6:
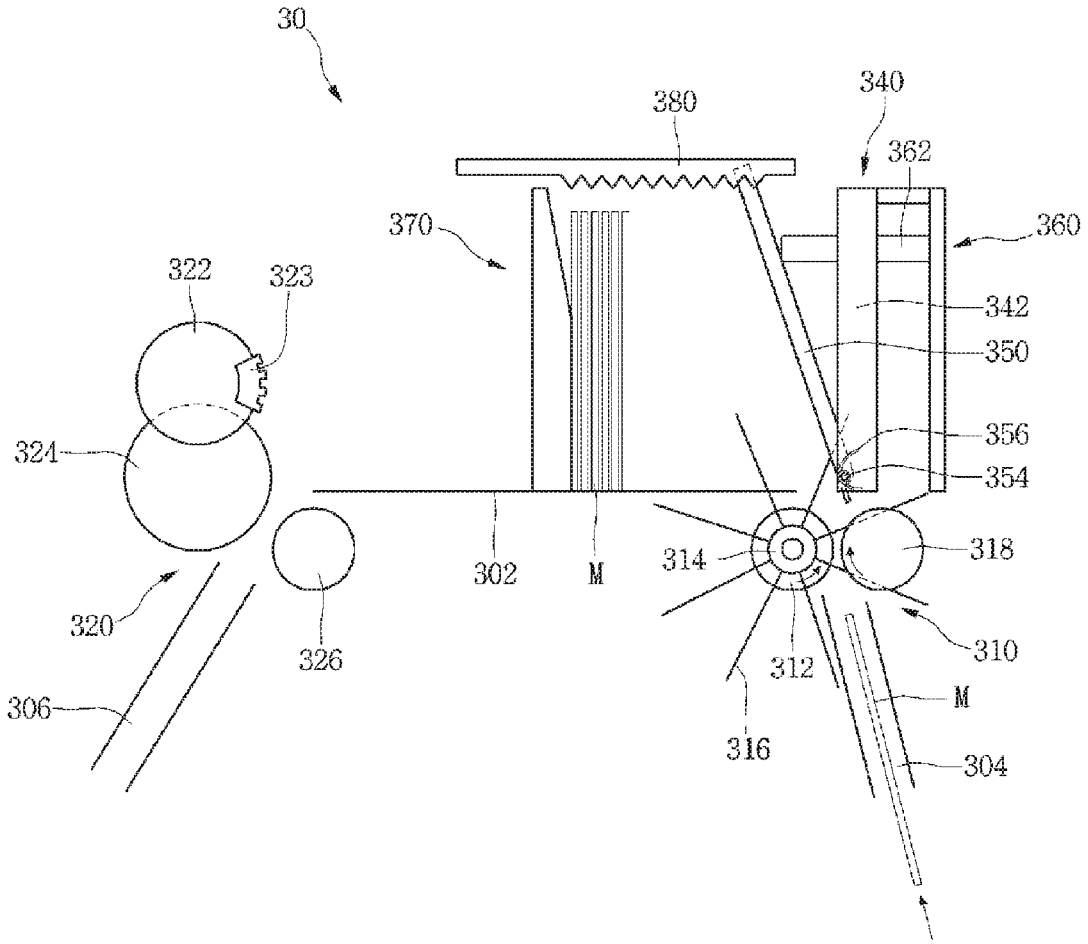
FIG. 6 is a view illustrating a process in which the medium is temporary stacked according to an embodiment.
Figure 7:
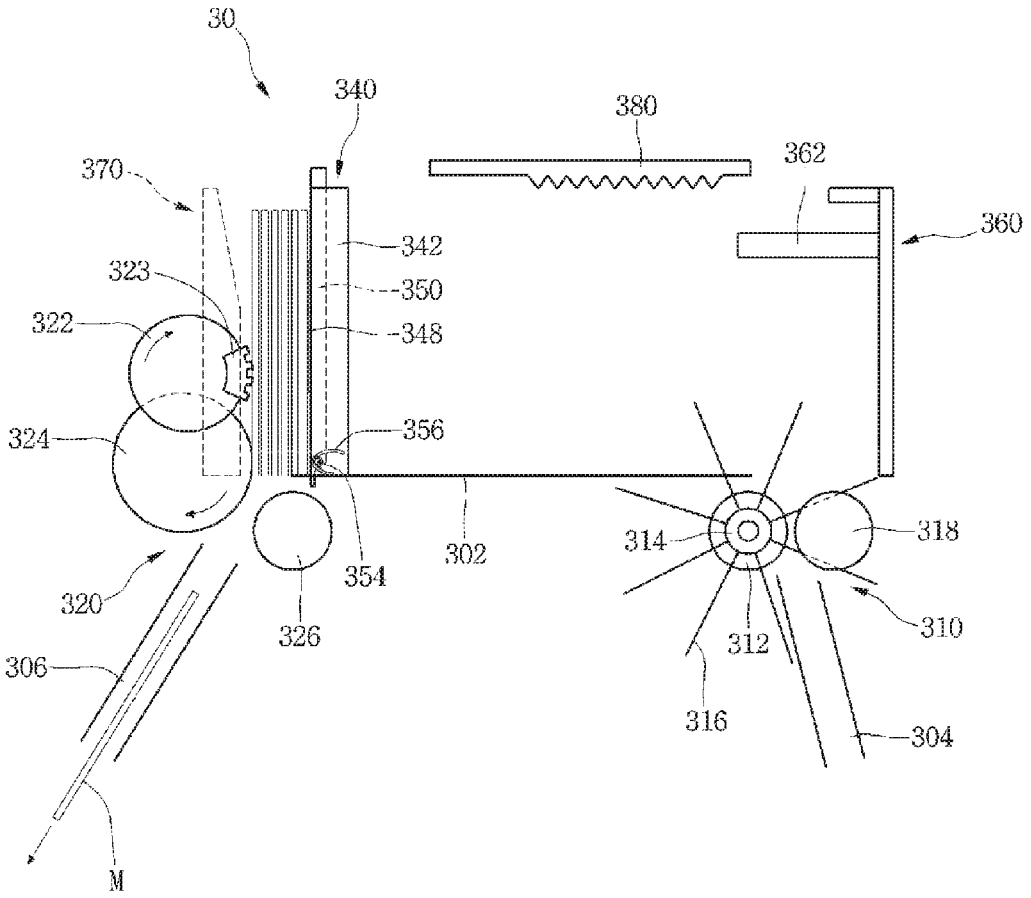
FIG. 7 is a view illustrating a process in which the temporary stacking medium is separated according to an embodiment.

FIG. 6 is a view illustrating a process during which the medium is temporarily stacked according to an embodiment, and FIG. 7 is a view illustrating a process in which the temporary stacking medium is separated according to an embodiment.

First, referring to FIG. 2 and FIG. 6, the medium may be accepted into the medium receiving space of the medium depositing and withdrawing unit 13, for deposit transactions for the medium. The medium accepted into the medium receiving space may be separated one by one by means of the medium separation device. The medium separated one by one passes through the discrimination unit 20.

The temporary stacking medium M determined as a normal medium of the mediums that passes through the discrimination unit 20 is transferred along the first path 304 and is stacked to the stacking space 303 by means of the first transfer device 310.

The second guide 370 and the first guide 340 may position at the stacking standby position for the temporary stacking medium.

In the stacking standby position, the second plate 350 maintains at the state rotated about the first plate 342. At this time, the second plate 350 is disposed to be inclined at a predetermined angle relative to the vertical line and thus guides the temporary stacking medium M which is transferred by means of the first transfer device 310. The angle between the second plate 350 and the stacking surface 302 may be the acute angle that is smaller than 90 degree.

At this time, since the friction portion 348 that is provided on the first plate 342 is not projected from the second plate 350, the stacking defect by the temporary stacking medium M being in contact with or is collided with the friction member 348 is generated may be prevented.

The second guide 370 may move in the direction away from the first guide 340 (in a left direction in FIG. 6) when the number of the temporary stacking medium M that is stacked in the stacking space 303 is increased.

The second guide 370 and the first guide 340 moves into the separation standby position as in the FIG. 7 in order to separate the temporary stacking medium M, when temporarily stacking of the temporary stacking medium M in the stacking space 303 is completed.

The second guide 370 and the first guide 340 may move toward the second transfer device 320 (toward the left direction on the drawing) so that the second guide 370 and the first guide 340 is moved from the stacking standby position to the separation standby position.

Since the second guide 370 and the first guide 340 moves in a state where the temporary stacking medium M is positioned between the second guide 370 and the first guide 340, the second guide 370 and the first guide 340 may be moved at a same speed with each other in order to prevent from falling down the temporary stacking medium M.

The second plate 350 is overlapped with the first plate 342 by an elastic force of the elastic member 356 by the first guide 340 being away from the rotating guide 360 during the process in which the first guide 340 moves to the separation standby position.

The friction portion 348 is in contact with the temporary stacking medium (the medium that is disposed on the outermost right side on the drawing) which is most lastly introduced into the stacking space 303 of the temporary stacking mediums M by the projecting portion 346 having the friction portion 348 passing through the second plate 350 during the process in which the second plate 350 is overlapped with the first plate 342.

The second plate 350 may be substantially perpendicular to the stacking surface 302 in a state that the second plate 350 is overlapped with the first plate 342.

The temporary stacking medium M may be spaced apart with the second guide 370 moved to the separation standby position being not interfered with the pick-up roller 322.

On the other hand, in a state where the guides 340 and 370 move to the separation standby position, the information of the medium being completed discrimination and then stacked to temporary stacking unit 30 and the information of the medium returned to the medium depositing and withdrawing unit 13 may be displayed to an user interface 11. Subsequently, deposit confirmation command or deposit cancellation command about medium stacked to the temporary stacking unit 30 through the user interface 11 may be input.

The medium stacked to the temporary stacking unit 30 may be separated and transferred by the second transfer device 320 and may be stored in the medium storage box 40 through the second path 306 when the deposit confirmation command is input through the user interface H.

The first guide 340 may press the temporary stacking medium M to the side of the pick-up roller 322 in the separation process of the temporary stacking medium M.

The pick-up roller 322 may have a high friction material of the pick-up portion 323 on a portion of the circumferential perimeter thereof. At this time, the pick-up portion 323 may be formed of a rubber material as an example.

The temporary stacking medium M may be picked up by the friction force between the temporary stacking medium M and the pick-up portion 323 in the case of the pick-up portion 323 being in contact with the temporary stacking medium M during the rotating process of the pick-up roller 322.

At this time, the friction force is increased in the case of the pick-up portion 323 being in contact with the temporary stacking medium M and phenomenon that the medium M contacted with or positioned adjacent to the first guide 340 of the mediums M by increasing this friction force is rotated may be generated. It is likely to cause a jam during the transfer of the medium by generating skew in a case where a portion of the medium M is separated from the rotated state.

However, according to the present embodiment, since the most lastly positioned medium of the temporary stacking mediums M is in contact with the friction portion 348 in a state of supporting by the first guide 340, there is an advantage that rotation of the most lastly positioned medium of the temporary stacking mediums M is prevented.

At this time, the friction portion 348 may be disposed to face with the pick-up portion 323 when the pick-up portion 323 is in contact with the temporary stacking medium M. Alternatively, it is possible that a plurality of the friction portion 348 are disposed to be spaced apart in a horizontal direction and the area between two friction portions 348 adjacent to each other and the pick-up portion 323 is disposed to be faced with each other.

On the other hand, the hinge shaft 354 of the second plate 350 is positioned at the position lower or equal than the point at which the pick-up portion 323 is in contact with the temporary stacking medium M.

The direction in which the second plate 350 is capable of rotating is a direction approaching the pick-up roller 322 (in the counter-clockwise direction on the drawing). Meanwhile, in a case where the hinge shaft 354 is positioned at the higher height than the point at which the pick-up portion 323 is in contact with the temporary stacking medium M, during the process in which the first guide 340 pushes the temporary stacking medium M and during the process in which the pick-up roller 322 picks up the temporary stacking medium 340, a force applies to the underside of the hinge shaft 354 and thus the second plate 350 is about to rotate, and in this case there is a problem that pick-up defects is generated by the pressing force of the temporary stacking medium M being changed. However, according to the present invention, the generation of such a problem may be prevented.

However, in a case where the fixing means for fixing the position of the second plate 350 is provided with the second plate 350 being overlapped with the first plate 342, it is possible that the hinge shaft 354 of the second plate 350 is positioned at the higher height than point at which the pick-up portion 323 is in contact with the temporary stacking medium M.

According to the present embodiment, since the first guide serves as a stacking guide in the case of stacking the medium and serves as a pressing portion that presses the medium in the case of separating the medium, the number of the guide provided in the temporary stacking unit may be reduced and thus the structure of the temporary stacking unit is simplified.

Further, since the second plate constituting the first guide is rotated about the first plate or overlapped with the first plate without a separate driving means, increasing in cost and complication of the structure according to arrangement of the driving means may be prevented.

In addition, the friction portion of the first guide may be in contact with the medium at the separation of the medium and thus the rotation of the separating non-target medium is prevented.

Figure 8:
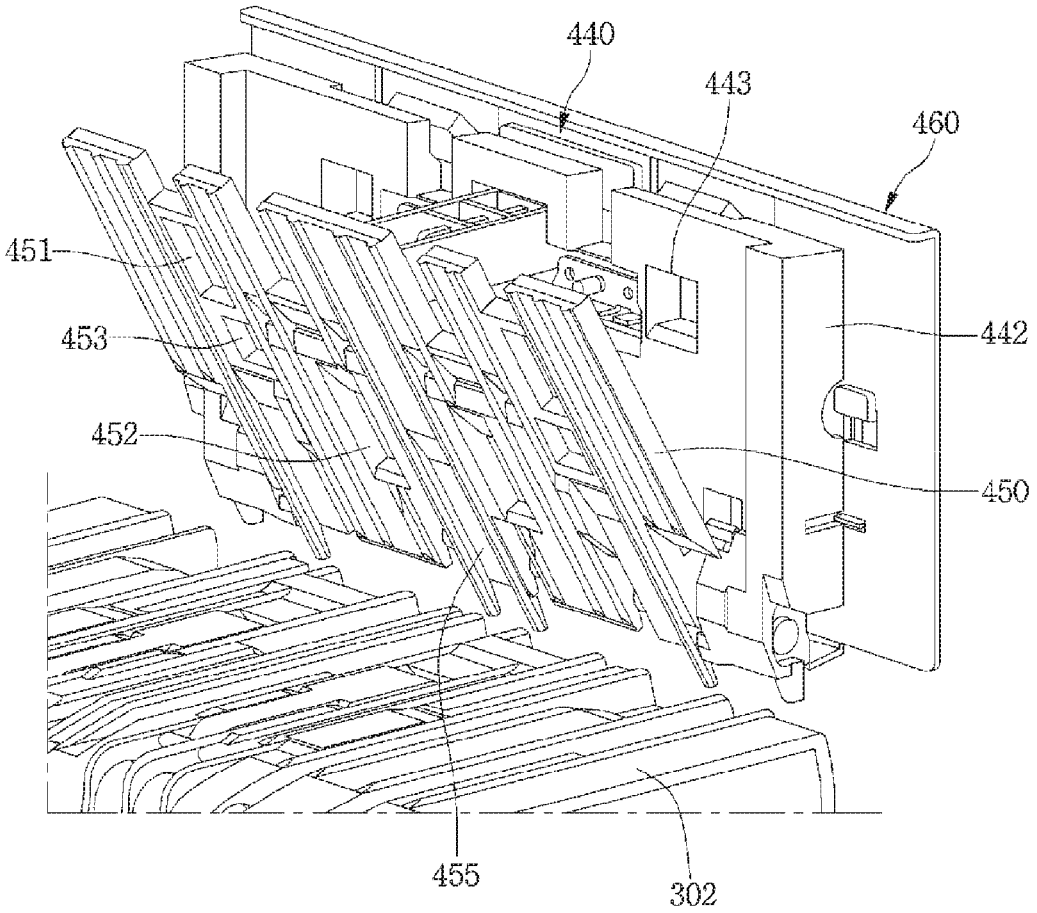
FIG. 8 is a view illustrating a state where a second plate is rotated in a first guide according to another embodiment.
Figure 9:
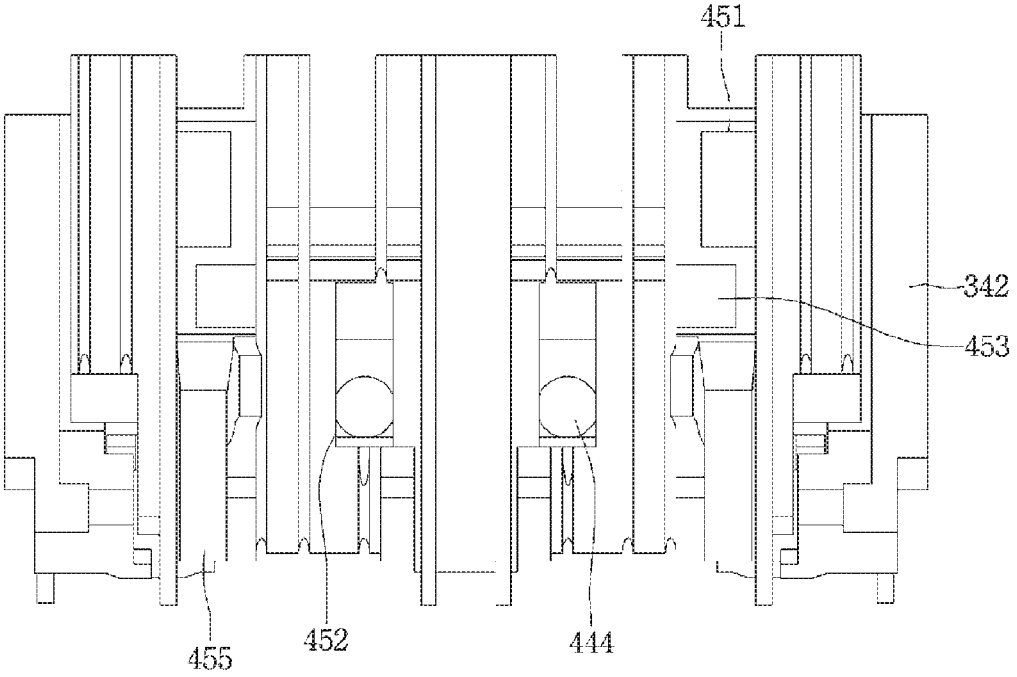
FIG. 9 is a view illustrating a state where the second plate is overlapped with the first guide according to another embodiment.
Figure 10:
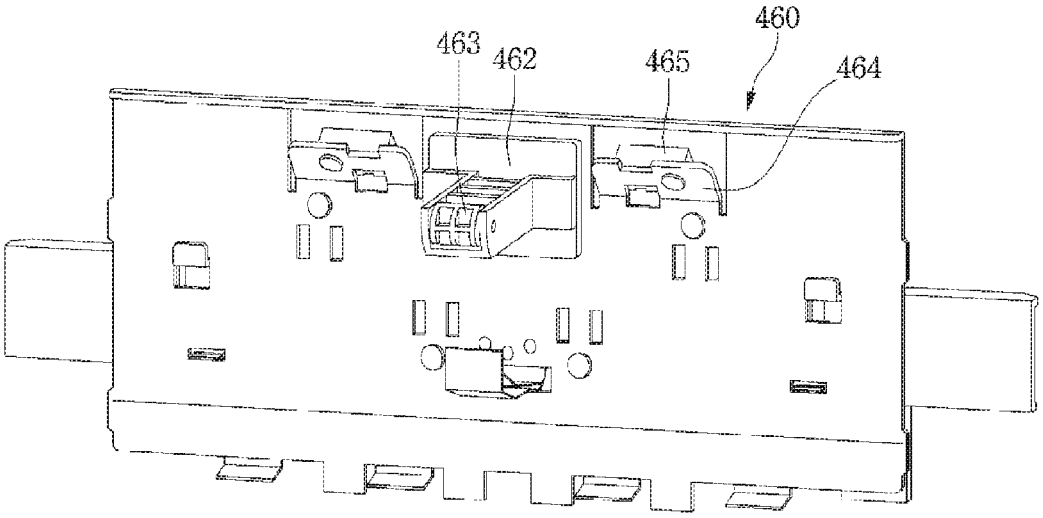
FIG. 10 is a perspective view illustrating a rotating guide according to another embodiment.

FIG. 8 is a view illustrating a state where a second plate is rotated in a first guide according to another embodiment, FIG. 9 is a view illustrating a state where the second plate is overlapped with the first guide according to another embodiment, and FIG. 10 is a perspective view illustrating a rotating guide according to another embodiment.

The present embodiment is the same as the previous embodiment except for the structures of the first guide and a rotating guide. Therefore, hereinafter, only the characteristic parts of this embodiment will be described, and the same parts as those of the previous embodiment will be quoted the contents of the previous embodiment.

Referring to FIG. 8 to FIG. 10, according to the present embodiment, the first guide 440 may comprise a first plate 442 and a second plate 450 that is rotatably connected to the first plate 442.

A first sensor (not shown) for detecting whether or not the medium is present in the stacking space 303 and a second sensor 465 for detecting whether or not the medium is present in falling down state in the stacking surface 302 in the stacking space 303 are provided in the temporary stacking unit 30.

Each of the sensor 465 may have a light emitting unit and light receiving unit. When the light emitted from the light emitting unit of the first sensor does not reach the light receiving unit, it may be determined that the medium is present in the stacking space 303. Further, when the light emitted from the light emitting unit of the second sensor 465 does not reach the light receiving unit, it is determined that the medium is present in falling down state in the stacking space 303. However, in the present embodiment, it is not limited regarding to a sensing method, the whether or not the medium is present and the medium is in the falling down state may be detected using various methods.

The first sensor may be disposed to be arranged in the vertical direction as a plurality of the sensor. However, it is not limited to such a method.

A first opening 443 and a second opening 444 for passing through the light emitted from the light emitting unit of the first sensor may be comprise in the first guide 442. The first opening 443 and the second opening 444 is disposed to be spaced apart in the vertical direction.

A third opening 451 through which the light passing through the first opening 443 is passed and the fourth opening 452 through which the light passing through the second opening 444 is passed may be comprised in the second guide 450.

At this time, the light emitted from the light emitting unit of the first sensor can be pass through the first opening 443 and the second opening 444 and then can be pass through the third opening 451 and the fourth opening 452 even in a state where the second plate 450 is overlapped with the first plate 442, as well as the light emitted from the light emitting unit of the first sensor can be pass through the first opening 443 and the second opening 444 and then can be pass through the third opening 451 and the fourth opening 452 even in a state where the second plate 450 is rotated about the first plate 442. To this end, the third opening 451 and the fourth opening 452 may be formed to be lengthened in the vertical direction.

A rotating guide 460 may further comprise in the temporary stacking unit 30. The second sensor 465 may be installed in the rotating guide 460 of the present embodiment. At this time, an inclined installing portion 464 is provided in the rotating guide 460 and the second sensor 465 is stalled in the installing portion 464.

The light emitted from the light emitting unit of the second sensor 465 may pass through the first opening 443. A fifth opening 453 through which the light emitted from the light emitting unit of the second sensor 465 passes is provided in the second plate 450.

The second sensor 465 may detect the falling down of medium in the stacking process of the medium and the light emitted from the light emitting unit of the second sensor 465 is capable of passing through the first opening 443 and the fifth opening 453 in a state where the second plate 450 is rotated about the first plate 442.

The rotating guide 460 may comprise a push portion 462 that pushes the second plate 450 so that the second plate 450 is rotated about the first plate 442. At this time, a sliding member (463, roller or the like, for example) that may be capable of sliding with the second plate 450 without the wear of the push portion 462 is provided on the end portion of the push portion 462 when the second plate 450 is pushed and thus rotates about the first plate 442.

A groove (or a hole) 455 in which a portion of the pick-up roller 332 is received may be formed in the second plate 450. In a case where the groove (or hole) for shielding the pick-up roller 322 is formed on the second plate 450, a portion of the medium lastly positioned is received in the groove (or hole) for shielding and thus curl is generated in the medium. In this case, the deviation of the friction force between a plurality of the portions facing the pick-up roller 322 in the medium lastly positioned and the first guide 440 is reduced and thus the lastly positioned medium of the mediums M in the pick-up process of the medium M is prevented from being rotated.

According to the embodiment described above, it is described that the temporary stacking medium for stacking in the first path is transferred and the temporary stacking medium separated in the second path is transferred. However, alternatively, it is possible to transfer the temporary stacking medium for stacking in the first path as well as to transfer the separated temporary stacking medium. In this case, the first transfer device may be omitted, and the second guide may have the same or similar structure as the structure of the first guide described above.

However, in this case, the second plate which is a guide rotated in the second guide may be configured to be rotated in the clockwise direction on the drawings about the first plate and thus to guide the stacking of the medium.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or has) only those elements, or it may comprise (or include or have) other elements as well as those elements if there is no specific limitation. Unless otherwise specifically defined herein, all terms including technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention. Therefore, the preferred embodiments should be considered in descriptive sense only and not for purposes of limitation, and also the technical scope of the invention is not limited to the embodiments. Furthermore, all differences within the scope will be construed as being comprised by the amended claims.

What is claimed is:

1. A medium stacking apparatus, comprising;

a transfer device to transfer media;

a stacking surface to stack the media transferred by the transfer device;

a first guide to guide a stacking of the media and to press the media in case of separation of the media stacked on the stacking surface; and a second guide to support the media stacked on the stacking surface, wherein the first guide comprises a first plate, and a second plate rotatably connected to the first plate, wherein the second plate is rotated about the first plate in case of stacking the media, and wherein a portion of or the entire second plate is overlapped with the first plate in case of separation of the media.

2. The medium stacking apparatus of claim 1, wherein the first plate and the second plate move together and press the media supported on the second guide, in case of separation of the media.

3. The medium stacking apparatus of claim 1, further comprising;

an elastic member that provides a rotating force to the second plate so that the second plate is rotated in the overlapped direction with the first plate.

4. The medium stacking apparatus of claim 1, wherein the first plate comprises a projecting portion in which a friction portion is provided, wherein the second plate comprises a through hole through which the projecting portion is passed, wherein the projecting portion is positioned at the rear side of the guide surface of the second plate in a state where the second plate is rotated about the first plate, and wherein the friction portion is projected toward the second guide from the guide surface in a state where the second plate is overlapped with the first plate.

5. The medium stacking apparatus of claim 1, wherein the second plate comprises a friction portion that is capable of being in contact with the medium stacked on the stacking surface in the case of separating of the medium, and wherein the friction portion is movably connected to the second plate in order not to project from the guide surface of the second plate in the case of separating of the medium.

6. The medium stacking apparatus of claim 1, further comprising;

a pick-up roller that picks up the media to separate the media stacked on the stacking surface, wherein a groove or a hole for receiving the media or the pick-up roller is formed on the second plate.

7. The medium stacking apparatus of claim 1, further comprising;

a rotating guide that causes the second plate to be rotated about the first plate during a process in which the first guide moves to a stacking standby position for the stacking of the media.

8. The medium stacking apparatus of claim 7, wherein the rotating guide comprises a push portion that pushes the second plate through the first plate if the first guide moves towards the rotating guide.

9. The medium stacking apparatus of claim 8, further comprising;

a sliding member capable of sliding with the second plate when being in contact with the second plate, the sliding member being provided at an end portion of the push portion.

10. The medium stacking apparatus of claim 1, further comprising;

a pick-up roller that picks up the media to separate the media stacked on the stacking surface;

wherein the pick-up roller comprises a pick-up portion for picking up the media by a friction force between the media and the pick-up portion, the pick-up portion being provided on a portion of a circumferential perimeter of the pick-up roller, wherein the second plate is rotatably coupled to the first plate by a hinge shaft, and wherein the hinge shaft is positioned below a point at which the pick-up portion is in contact with the media.

11. The medium stacking apparatus of claim 1, further comprising;

a sensor to detect whether the media are present on the stacking surface, and first and second openings, through which light emitted from a light emitting unit of the sensor is transmitted, provided on the first plate and the second plate, respectively.

12. The medium stacking apparatus of claim 11, wherein the second opening of the second plate is formed based on a path and a rotating path of the light so that the light emitted from the emitting unit of the sensor is capable of transmitting through the second plate, when the second plate is overlapped with the first plate or when the second plate is rotated about the first plate.

13. The medium stacking apparatus of claim 1, further comprising;

a sensor for detecting whether the media are present in a collapsed state on the stacking surface, and first and second openings, through which light emitted from a light emitting unit of the sensor is transmitted, provided on the first plate and the second plate, respectively.

14. The medium stacking apparatus of claim 1, wherein a portion of the second plate is positioned below the stacking surface when the second plate is rotated about the first plate.

15. The medium stacking apparatus of claim 1, further comprising;

a damper with which the media guided by the first guide are collided, and wherein a portion of the second plate is disposed to be overlapped with the damper when the second plate is rotated about the first plate.

16. A financial device, comprising;

a customer information acquisition part that acquires customer's information;

a user interface unit that displays a menu and information for depositing or withdrawing a medium and for inputting or selecting a command or information for depositing or withdrawing a medium; and a medium stacking apparatus to stack media, wherein the medium stacking apparatus comprises a plurality of guides capable of supporting or moving the media;

wherein one guide of the plurality of the guides comprises a first plate, and a second plate that is rotatably connected to the first plate;

wherein the second plate is rotated about the first plate in case of stacking the media, and wherein a portion of or the entire second plate is capable of pressing the media to a side of another guide of the plurality of guides when the portion or the entire second plate is overlapped with the first plate in case of separation of the media, and wherein a groove or a hole for receiving the media or a pick-up roller is formed on the second plate.

17. The financial device of claim 16, wherein the medium stacking apparatus further comprises a rotating guide that causes the second plate to be rotated with respect to the first plate during a process in which the one guide moves in a direction away from the another guide for the stacking of the media.

18. The financial device of claim 17, wherein the rotating guide comprises a push portion that pushes the second plate through the first plate when the one guide moves towards the rotating guide.

19. The financial device of claim 16, wherein the medium stacking apparatus comprises at least one of a medium depositing and withdrawing unit for depositing and withdrawing the media and a temporary stacking portion for temporarily stacking the media.

20. A medium stacking apparatus, comprising;

a stacking surface to stack media;

a first guide to guide stacking of the media and to press the media in case of separation of the media stacked on the stacking surface;

a second guide to support the media stacked on the stacking surface; and a rotating guide;

wherein the first guide comprises a first plate and a second plate rotatably connected to the first plate, wherein the second plate is rotated about the first plate when the media are stacked, and wherein a portion of or the entire second plate is overlapped with the first plate in case of the separation of the media, and wherein the rotating guide drives the second plate to be rotated about the first plate during a process in which the first guide moves to a stacking standby position for the stacking of the media.

* * * * *